US005980077A

United States Patent [19]

Shiao

[11] Patent Number: 5,980,077

[45] Date of Patent: Nov. 9, 1999

[54] ILLUMINATING DRIVING TOOL

[76] Inventor: Hsuan-Sen Shiao, No. 15-1, La. 369, Min-Chuan Rd., Taichung, Taiwan

[21] Appl. No.: 09/212,716

[22] Filed: Dec. 16, 1998

[51] Int. Cl.[6] ..... B25B 23/18

[52] U.S. Cl. ..... 362/578; 362/120

[58] Field of Search ..... 362/109, 119, 362/120, 578, 577

[56] References Cited

U.S. PATENT DOCUMENTS 2,242,536 5/1941 Montgomery ..... 362/578

2,706,769 4/1955 Cook ..... 362/578

*Primary Examiner*—Stephen Husar

*Attorney, Agent, or Firm*—Foley & Lardner

[57] ABSTRACT

An illuminating driving tool includes an elongated hollow handle having an accommodating space for receiving a power source therein, an illuminating device disposed at one end of the handle and adapted to be connected electrically to the power source inside the accommodating space, an adapter made of a light-transmittable material and mounted on the handle, the adapter having an receiving chamber for receiving the illuminating device, and an elongated tool member having a bit operating end for driving a screw and a mounting plug for coupling detachably and non-rotatably to the adapter.

10 Claims, 5 Drawing Sheets

ILLUMINATING DRIVING TOOL

BACKGROUND OF THE INVENTION

1. Field of the Invention

The present invention relates to a driving tool, more particularly to a driving tool with illuminating capability.

2. Description of the Related Art

A conventional driving tool is commonly used in computers, eyeglasses, and precision machinery for turning screws. An example of the prior art driving tool is shown in FIG. 1. The prior art driving tool includes a shank 1*a*, a driving head 1*b* connected axially to the shank 1*a*, and a rotary knob 1*c* of a hexagonal cross section mounted on the shank 1*a*. In use, the driving tool 1 is turned clockwise or counterclockwise for tightening or loosening a screw with the thumb and the middle finger of a hand cooperatively holding and rotating the shank 1*a* while the index finger of the same hand presses the knob 1*c* from above to keep the driving tool 1 in position.

When the conventional driving tool 1 is used in the dark, however, a problem arises. The operator has to use his other hand to hold a lighting apparatus, such as a flashlight, so as to make it possible to perform the driving operation in the dark. As such, the operation of the driving tool is adversely affected and becomes troublesome.

SUMMARY OF THE INVENTION

Therefore, the object of the present invention is to provide an illuminating driving tool which can be used in the dark without the help of an additional lighting apparatus.

Accordingly, the illuminating driving tool of this invention includes: an elongated hollow handle having a connecting end, an operating end opposite to the connecting end, and an accommodating space between the connecting end and the operating end and adapted to receive a power source therein; an illuminating device disposed at the connecting end of the handle and adapted to be connected electrically to the power source inside the accommodating space; an adapter made of a light-transmittable material and having a first end and an opposite second end, the first end of the adapter being mounted on the connecting end of the handle and being formed with a receiving chamber to receive the illuminating device; and an elongated tool member having an axis along which a bit operating end and a mounting plug are formed, the mounting plug being coupled detachably and non-rotatably to the second end of the adapter such that the illuminating device is coaxial with the axis of the tool member.

BRIEF DESCRIPTION OF THE DRAWINGS

The features and advantages of the present invention will be described in more detail with reference to the accompanying drawings which illustrate the preferred embodiment of this invention, wherein.

DETAILED DESCRIPTION OF THE PREFERRED EMBODIMENT

Figure 1:
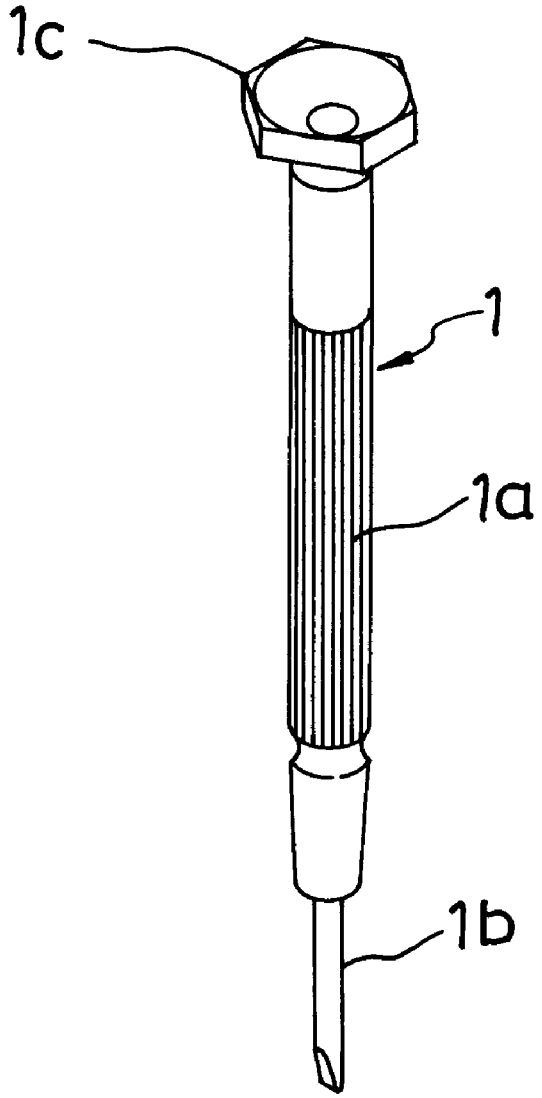
FIG. 1 PRIOR ART
FIG. 1 is a perspective view of a conventional driving tool.
Figure 2:
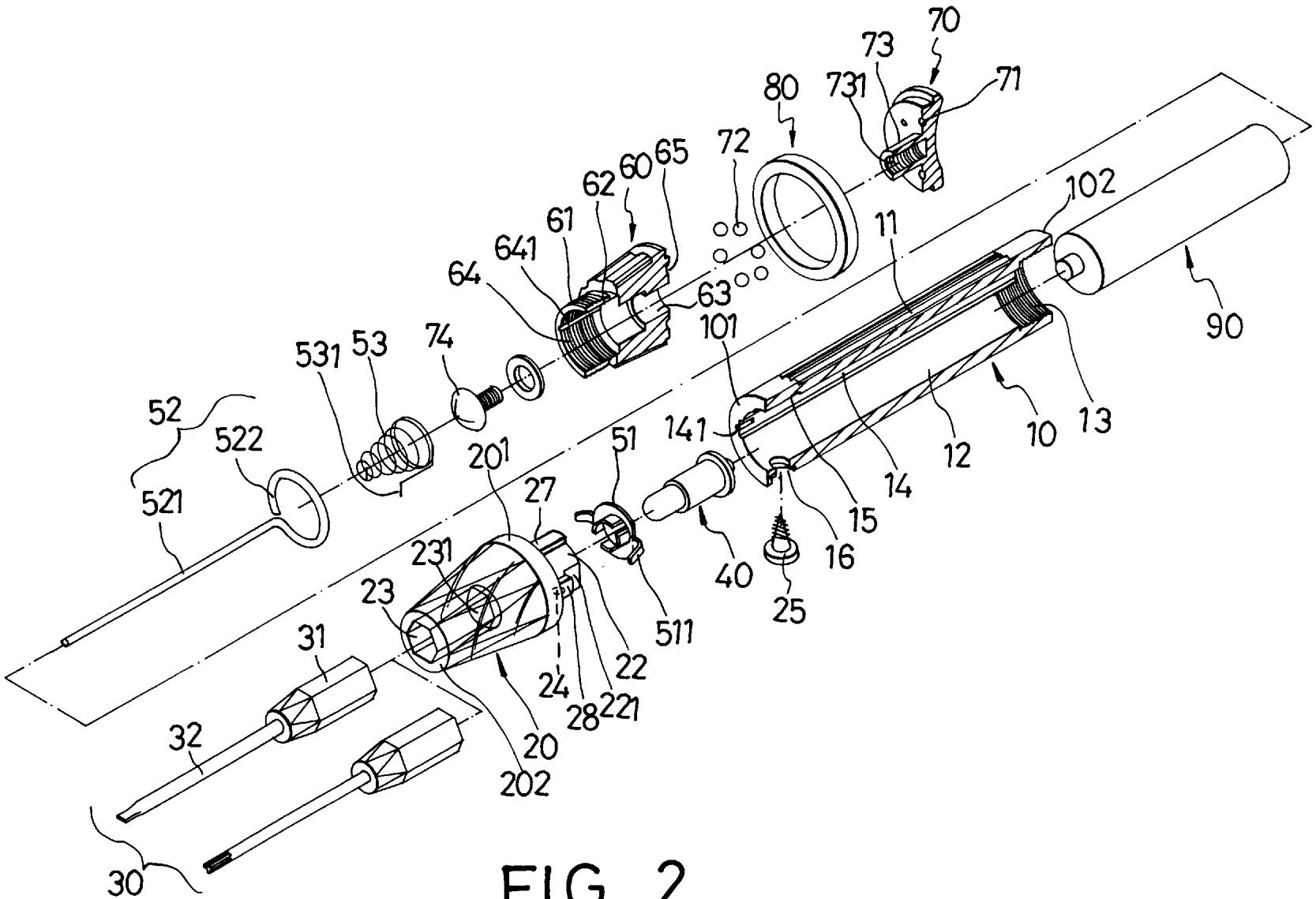
FIG. 2 is an exploded view of a preferred embodiment of this invention.
Figure 3:
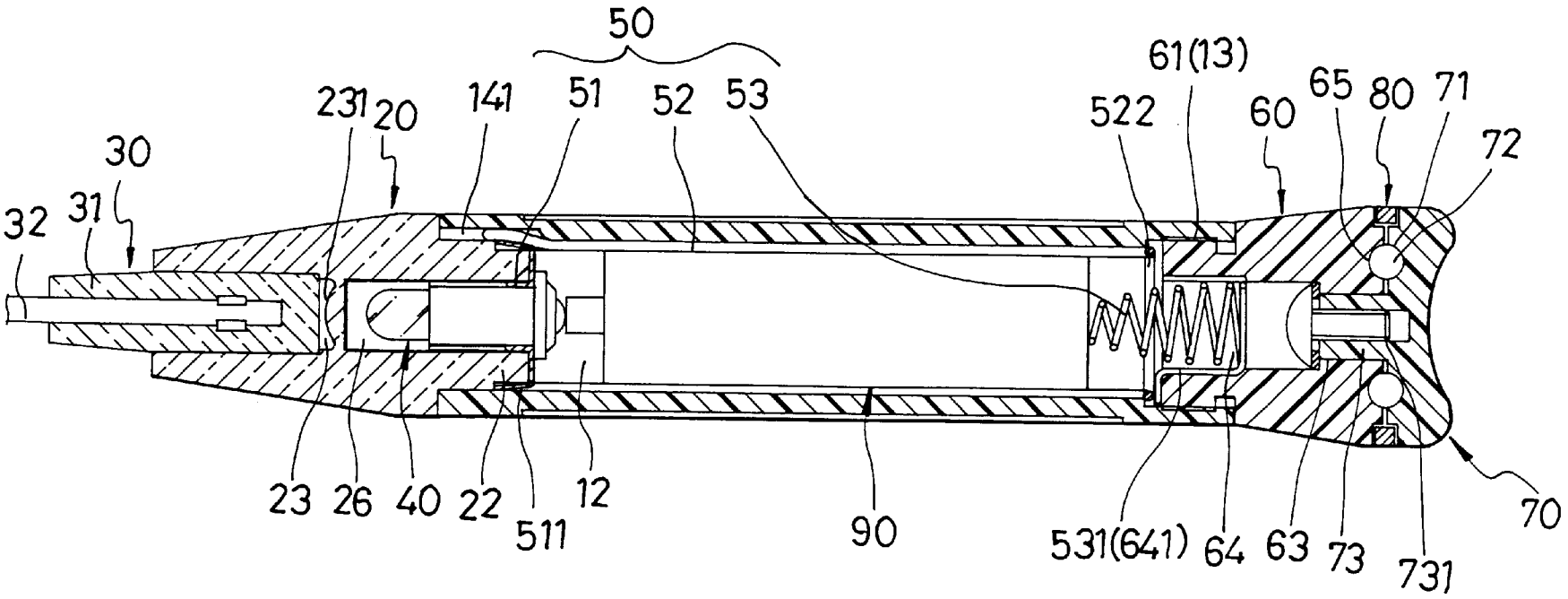
FIG. 3 is an assembled sectional view of the preferred embodiment to show an operating position thereof.

Referring to FIGS. 2 and 3, the preferred embodiment of an illuminating driving tool of this invention is shown to include an elongated hollow handle 10, an illuminating device 40, an adapter 20, and an elongated tool member 30.

The handle 10 has a connecting end 101, an operating end 102 opposite to the connecting end 101, and an accommodating space 12 formed between the ends 101, 102 for receiving a power source therein. In this embodiment, the power source is a battery 90. The handle 10 is made of an insulator material, and has a splined outer wall 11 to facilitate gripping of the handle 10. The operating end 102 of the handle 10 is provided with an internal thread 13. The inner wall of the handle 10 is provided with an upper engaging groove 15 formed longitudinally at the connecting end 101, and two side engaging grooves 14 extending longitudinally from the connecting end 101 to the operating end 102. At the connecting end 101, the inner wall of the handle 10 is additionally provided with a recess 141 and a radial hole 16. The adapter 20, which is made of a light-transmittable material, has a first end 201 and an opposite second end 202. The first end 201 of the adapter 20 is formed with a mounting block 22 for mounting the adapter 20 on the connecting end 101 of the handle 10. The mounting block 22 has a threaded hole 24 corresponding to the radial hole 16 in the handle 10. By using a screw 25 that passes through the holes 16 and 24, the adapter 20 is mounted tightly on the handle 10. A receiving chamber 26, shown in FIG. 3, is formed in the mounting block 22, and the mounting block 22 extends into the connecting end 101 so that the receiving chamber 26 can receive the illuminating device 40.

The mounting block 22 is provided with two side engaging protrusions 28 and an upper engaging protrusion 27 for engaging the side engaging grooves 14 and the upper engaging groove 15 formed in the inner wall of the handle 10, respectively. Each of the side engaging protrusions 28 is formed with a notched portion 221 at one end adjacent to the connecting end 101 of the handle 10.

Preferably, the adapter 20 is tapered from the first end 201 to the second end 202.

An engaging hole 23 with a non-circular cross section is formed in the second end 202 of the adapter 20. In this embodiment, the engaging hole 23 is of a hexagonal cross section for engaging non-rotatably a tool member 30. As clearly seen in FIG. 3, the engaging hole 23 has a convex bottom surface 231 for guiding light emitted from the illuminating device 40.

The illuminating device 40 is a light bulb received inside the receiving chamber 26. The positive terminal of the illuminating device 40 is connected to the positive terminal of the battery 90.

The elongated tool member 30 has a bit operating end 32 for turning a screw, and a mounting plug 31 for engaging the engaging hole 23 of the adapter 20. The tip of the bit operating end 32 can be of various shapes, such as a flat or a cross-shape, so as to be adapted for working with different screws. The mounting plug 31 is made of a light-transmittable material, and is coupled detachably and non-rotatably to the engaging hole 32 of the adapter 20. The illuminating device 40 is disposed coaxial with the axis of the tool member 30.

A conducting unit 50, including a conducting rod 52 and a conducting spring 53, is mounted in the handle 10 and is adapted to connect electrically the illuminating device 40 and the negative terminal of the battery 90.

The conducting rod 52 includes a rod portion 521 and a loop portion 522 at one end of the rod portion 521. The conducting spring 53 has a coil portion and a contacting portion 531. The free end of the rod portion 521 serves as a first contact connected electrically to the negative terminal of the illuminating device 40 via a leaf spring 51. The loop portion 522 serves as a second contact for connecting electrically with the contacting portion 531 of the conducting spring 53. The conducting rod 52 is disposed in the accommodating space 12 with its rod portion 521 inserted into one of the side engaging grooves 14 and with the loop portion 522 located adjacent to the internal thread 13 of the handle 10. When the adapter 20 engages the connecting end 101 of the handle 10 and is firmly fastened by the screw 25 that passes through the holes 16 and 24, the free end of the rod portion 521 of the conducting rod 52 is biased into the recess 141 by one of the engaging protrusions 28 so that the conducting rod 52 is held in position and is in electrical contact with the leaf spring 51.

The leaf spring 51, which is made of a highly conductive metal, is provided around the illuminating device 40 so as to connect electrically with the negative terminal of the illuminating device 40. Two fastening elements 511 extend from the leaf spring 51 in locations corresponding to the notched portions 221 formed in the adapter 20 so that, by virtue of engagement between the fastening elements 511 and the notched portions 221, the illuminating device 40 can be fastened to the adapter 20 and received inside the receiving chamber 26.

The conducting unit 50 further includes an operating knob 60 made of an insulator material and mounted rotatably and adjustably on the operating end 102 of the handle 10. The operating knob 60 has a coupling tube 61 that is threaded externally to engage the internal thread 13 of the handle 10. The operating knob 60 has a cavity 63 that extends along the length of the operating knob 60 and that is enlarged at the coupling tube 61 to form an enlarged cavity portion 64 where the conducting spring 53 is received. A shoulder is formed between the cavity 63 and the enlarged cavity portion 64.

The conducting spring 53 is disposed inside the enlarged cavity portion 64 at the coupling tube 61 of the operating knob 60. A first end of the coil portion of the conducting spring 53 bears against the shoulder formed between the cavity 63 and the enlarged cavity portion 64. The second end of the coil portion of the conducting spring 53 abuts against the negative terminal of the battery 90. The inner wall of the coupling tube 61 is formed with a longitudinal groove 641 for receiving the contacting portion 531 of the conducting spring 53. The contacting portion 531 extends from the first end of the coil portion of the conducting spring 53 toward the battery 90, and is bent to bear against an end surface of the coupling tube 61 for connecting electrically with the loop portion 522 which, when assembled, is located adjacent to the internal thread 13 of the handle 10.

The coupling tube 61 is preferably formed with two axial slits 62 to permit radial outward expansion of the coupling tube 61 for tight engagement between the operating knob 60 and the handle 10.

Referring to FIG. 3, in assembly, when the coupling tube 61 of the operating knob 60 is threaded into the handle 10, the positive terminals of the battery 90 and the illuminating device 40 are brought into contact, and the negative terminal of the battery 90 and the conducting spring 53 are electrically connected. Also, the bent section of the contacting portion 531 of the conducting spring 53 is brought into contact with the loop portion 522 of the conducting rod 52. The free end of the rod portion 521 of the conducting rod 52 is connected electrically to one of the fastening elements 511 of the leaf spring 51 which surrounds the illuminating device 40 and which is connected to the negative terminal of the latter. As a result, a closed electric circuit is established to enable the illuminating device 40 to generate light in preparation for use of the illuminating driving tool in the dark.

Since the adapter 20 and the mounting plug 31 of the tool member 30 are both made of a light-transmittable material, the light emitted from the illuminating device 40 can be sent out to the working region around the bit operating end 32 of the tool member 30, thus providing the illuminating.

Figure 4:
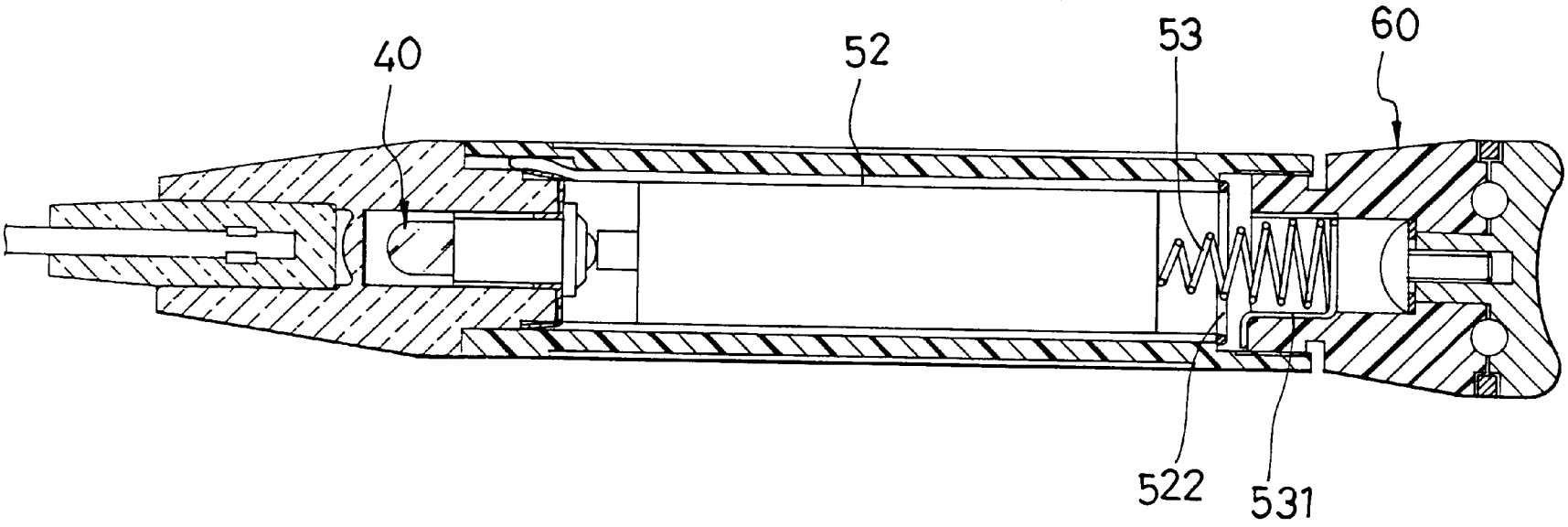
FIG. 4 is an assembled sectional view of the preferred embodiment to show another operating position thereof.

When it is desired to turn off the illuminating device 40, the operating knob 60 is threaded out of the handle, and the contacting element 531 of the conducting spring 53 moves along with the operating knob 60 such that the bent section of the contacting portion 531 disengages the loop portion 522 of the conducting rod 52 so that the electric circuit is opened, as shown in FIG. 4.

A finger support plate 70, mounted rotatably on the operating knob 60, is rotatable relative to the handle 10. The support plate 70 is provided with a shaft 73 which is inserted into the cavity 63 of the operating knob 60, and has an axial threaded hole 731 for engaging a self-tapping screw 74 provided inside the operating knob 60. Thus, the finger support plate 70 can be axially secured to the operating knob 60. The confronting surfaces between the operating knob 60 and the finger support plate 70 are each formed with a plurality of ball receiving grooves 65 and 71. The ball receiving grooves 65 and 71 of the operating knob 60 and the finger support plate 70 cooperatively receive ball bearings 72 therein to ensure smooth rotation of the support plate 70 relative to the operating knob 60.

In use, the driving tool is turned clockwise or counterclockwise for tightening or loosening a screw with the thumb and the middle finger of a hand cooperatively holding and rotating the handle 10 while the index finger of the same hand presses the operating knob 60 from above to keep the driving tool in position.

Preferably, a shield ring 80 is sleeved on and is disposed between the operating knob 60 and the finger support plate 70 to shield the gap formed therebetween. The shield ring 80 can be colored for aesthetic purposes.

Figure 5:
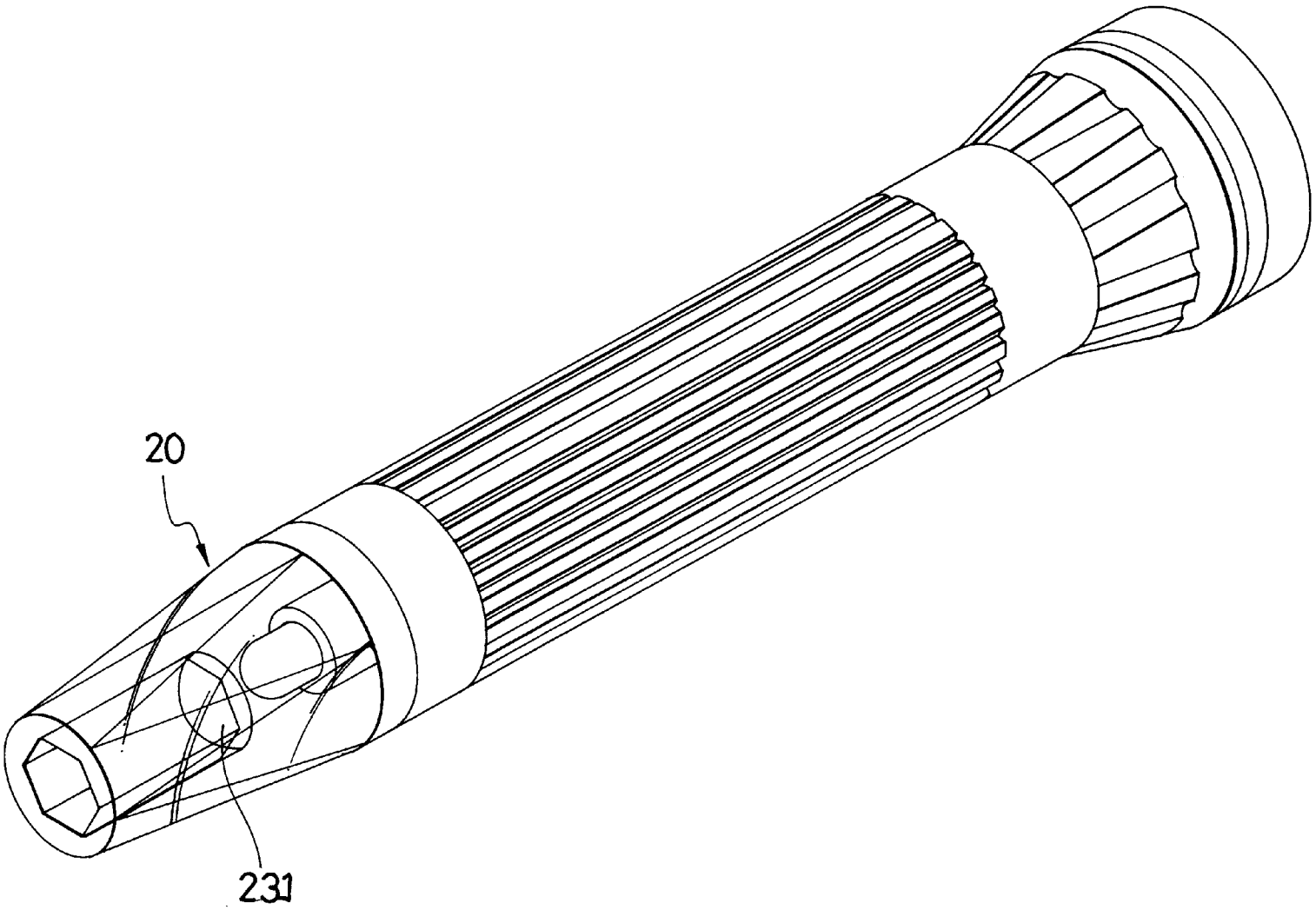
FIG. 5 is a perspective view showing how the driving tool of the preferred embodiment can be used as a flashlight.

Apart from the tool driving function, the illuminating driving tool of this invention can be used as a flashlight when the tool member 30 is removed, as shown in FIG. 5. With the convex bottom surface 231 of the engaging hole 23, the light emitted from the illuminating device 40 can be directed to pass through the engaging hole 23 and provide an enhanced lighting effect.

It should be understood that the above description is intended to be illustrative and not restrictive. A variety of modifications will be apparent to those skilled in the art within the sprit and scope of the invention as defined in the appended claims.

I claim:

1. An illuminating driving tool, comprising:

an elongated hollow handle made of an insulator material and having a connecting end, an operating end opposite to said connecting end, and an accommodating space between said connecting end and said operating end and adapted to receive a power source therein;

an illuminating device disposed at said connecting end of said handle and adapted to be connected electrically to the power source inside said accommodating space;

an adapter made of a light-transmittable material and having a first end and an opposite second end, said first end of said adapter being mounted on said connecting end of said handle and being formed with a receiving chamber to receive said illuminating device, said second end of said adapter being formed with an engaging hole;

an elongated tool member having an axis along which a bit operating end and a mounting plug are formed, said mounting plug engaging detachably and non-rotatably said engaging hole in said second end of said adapter such that said illuminating device is coaxial with said axis of said tool member; and a conducting unit mounted in said handle and adapted to connect electrically said illuminating device and the power source, said conducting unit including:

a conducting rod mounted in said accommodating space and having a first contact connected electrically to said illuminating device, and an opposite second contact;

a conducting spring disposed in said operating end of said handle and adapted to be connected electrically to the power source, said spring further having a third contact for connecting electrically with said second contact of said conducting rod; and an operating knob made of an insulator material and mounted movably and adjustably on said operating end of said handle, said spring being mounted on said operating knob, said operating knob being movable relative to said handle between a closed-circuit position, where said third contact on said spring is in contact with said second contact of said conducting rod to make electrical connection between said illuminating device and the power source, and an open-circuit position, where said third contact on said spring is moved away from said second contact of said conducting rod to break electrical connection between said illuminating device and the power source.

2. The illuminating driving tool as claimed in claim 1, wherein said mounting plug is made of a light-transmittable material.

3. The illuminating driving tool as claimed in claim 1, wherein said engaging hole in said second end of said adapter has a non-circular cross section.

4. The illuminating driving tool as claimed in claim 3, wherein said engaging hole of said adapter has a convex bottom surface for guiding light emitted from said illuminating device.

5. The illuminating driving tool as claimed in claim 1, wherein said operating knob is coupled threadedly to said operating end of said handle.

6. The illuminating driving tool as claimed in claim 1, wherein said operating end of said handle is threaded internally, said operating knob having a coupling tube that is threaded externally to engage said operating end of said handle.

7. The illuminating driving tool as claimed in claim 6, wherein said coupling tube is formed with two axial slits to permit radial outward expansion of said coupling tube for tight engagement between said operating knob and said handle.

8. The illuminating driving tool as claimed in claim 1, further comprising a finger support plate mounted rotatably on said operating knob, said finger support plate being rotatable relative to said handle.

9. The illuminating driving tool as claimed in claim 8, wherein said finger support plate and said operating knob have confronting surfaces formed with ball receiving grooves, said illuminating driving tool further comprising ball bearings disposed between said confronting surfaces of said finger support plate and said operating knob in said ball receiving grooves.

10. The illuminating driving tool as claimed in claim 1, wherein said handle has a splined outer wall to facilitate gripping of said handle.

* * * * *